United States Patent [19]

Bessinger et al.

[11] Patent Number: 4,549,774

[45] Date of Patent: Oct. 29, 1985

[54] DRAWER SLIDE APPARATUS

[75] Inventors: Walter L. Bessinger, Grand Haven; Keith A. Hoffman, Hudsonville, both of Mich.

[73] Assignee: Knape & Vogt Manufacturing Company, Grand Rapids, Mich.

[21] Appl. No.: 468,330

[22] Filed: Feb. 22, 1983

[51] Int. Cl.[4] ..... H47B 88/00; F16C 21/00

[52] U.S. Cl. ..... 308/3.8; 312/341 R; 312/347

[58] Field of Search ..... 308/3.8, 3.6; 312/344, 312/341 R, 343, 347, 349, 332

[56] References Cited

U.S. PATENT DOCUMENTS

| | | | |
|---|---|---|---|
| 567,693 | 9/1896 | Smith | 312/343 |
| 768,927 | 8/1904 | Billings | 312/344 |
| 1,111,026 | 9/1914 | Kroos | 312/344 X |
| 1,203,014 | 10/1916 | Kroos | 312/344 |
| 1,975,327 | 10/1934 | Loney | 312/343 |
| 2,517,823 | 8/1950 | Angell | 312/344 X |
| 2,873,150 | 2/1959 | Hutzelman | 308/3.8 |
| 3,851,943 | 12/1974 | Afful | 312/347 |
| 3,995,927 | 12/1976 | Stein | 308/3.8 X |

*Primary Examiner*—Stuart S. Levy
*Assistant Examiner*—Joseph J. Hail, III
*Attorney, Agent, or Firm*—Price, Heneveld, Huizenga & Cooper

[57] ABSTRACT

The specification discloses a drawer slide assembly providing automatic centering of the drawer within the cabinet opening and enabling a drawer of increased dimensions to be utilized in a given cabinet opening. The assembly includes a pair of cabinet channels secured to the cabinet and a pair of drawer rails secured to the drawer. The drawer rails ride on cabinet rollers supported at the forward ends of the channels. The cabinet rollers are mounted on an axis below the cabinet opening and are frustoconically shaped to cooperate with beveled surfaces on the drawer rails to guide the drawer to a centered position. The cabinet rollers, drawer rails, and drawer are vertically aligned so that the drawer can extend the full width of the opening. The rear ends of the cabinet channels are forked and extend into apertures in the cabinet rear wall to support the channels in the cabinet. A pair of drawer rollers ride in the channels and are supported at the rear of the drawer on drawer corner brackets fabricated from a single sheet of material folded upon itself to provide a strong roller supporting portion. Each channel includes a lateral guide wall inclined from the vertical to reduce frictional contact of the drawer rollers therewith.

10 Claims, 7 Drawing Figures

DRAWER SLIDE APPARATUS

BACKGROUND OF THE INVENTION

The present invention relates to drawer slides.

A variety of drawer slides have been developed for slidably mounting a drawer within a cabinet to facilitate movement of the drawer, especially when heavily loaded. Additionally, the slides provide linear movement of the drawer to prevent the drawer from "dropping" when extended out of the cabinet. Detents and stops are often incorporated into the slide both to secure the drawer in its closed position and to prevent the drawer from being inadvertently removed from the cabinet.

Most typically, the slide apparatus comprises a pair of assemblies mounted on opposite sides of the drawer between the drawer and the cabinet. However, this design has several disadvantages. First, the drawer slides are visible and somewhat unsightly when the drawer is pulled open. Second, the location of the drawer slides requires that the drawer be significantly narrower than the cabinet opening, reducing the volume of the drawer. Third, the drawer tends to shift laterally on the rails during drawer movement such that the drawer is often slightly skewed in the cabinet.

Some prior drawer slides include a cabinet channel fixedly secured within the cabinet, and a rotatable roller carried by the drawer and riding in the channel to support the drawer within the cabinet. Often, this drawer roller is supported on a corner bracket secured to and reinforcing a drawer corner. Prior brackets require excessive material in their fabrication due to the fact that, although a relatively thin gauge material is adequate to reinforce the drawer corner, a relatively heavy gauge material must be used to provide support for the drawer roller. Additionally, known cabinet channels include a generally vertical lateral guide surface against which the drawer roller bears while riding in the cabinet channel. The relatively large contact area between the roller and the vertical surface creates friction, increasing the force required to move the drawer and creating noise during drawer movement.

Further, in known slides, each cabinet channel is typically supported in the cabinet on front and rear mounting brackets at the front and rear portions of the cabinet. The rear bracket reduces the possible length of the drawers mounted on the slides because drawer clearance must be provided at the rear of the cabinet to accommodate the bracket. Second, channels including known rear brackets do not readily adapt to cabinets of slightly varying depth.

SUMMARY OF THE INVENTION

The aforementioned problems are solved by the present invention wherein a novel drawer slide apparatus enables greater use of the cabinet opening and provides the drawer with a self-centering movement within the cabinet opening. In a first aspect of the invention, the slide comprises cabinet roller structure, adapted to be rotatably supported within a cabinet, and a pair of drawer rails, adapted to be secured to a drawer to ride on the roller structure. At least one of (A) the rail-supporting periphery of the cabinet roller structure of (B) the drawer rails defines a downwardly tapering V-shape causing the drawer to seek a centered position as the rails slide on the rollers. Therefore, the drawer continually seeks a centered position during movement within the cabinet under any loading conditions.

In a second aspect of the invention, the drawer slide apparatus is vertically aligned substantially directly under the drawer enabling the drawer to extend the full width of the cabinet opening to provide increased drawer volume. More particularly, the drawer slide includes a pair of cabinet channels adapted to be secured within the cabinet below the drawer opening, a pair of rollers rotatably supported on the cabinet channels and each having an axis of rotation located below the drawer opening, and a pair of drawer rails adapted to be secured to a drawer and each including an undersurface located substantially directly under the drawer and carried on the rollers. Therefore, the drawer width and height can extend substantially the full width and height of the cabinet opening, enabling greater drawer size and volume than has previously been possible.

In a third aspect of the invention, a novel corner bracket is provided for joining two drawer portions at right angles and for rotatably supporting a drawer roller. More specifically, the bracket is fabricated from a single sheet of plate stock and includes a first planar portion adapted to be secured to one drawer member, a second planar portion adapted to be secured to a second drawer member generally perpendicular to the first drawer member, and a roller-supporting portion extending generally perpendicular from one of the first and second planar portions. The roller-supporting portion comprises two portions of the sheet stock folded against one another. Consequently, the requisite strength is provided to support the roller, while sheet stock of reduced thickness may be used to fabricate the bracket.

In a fourth aspect of the invention, the drawer slide includes a cabinet channel having a forked rear end which extends through mating apertures in the cabinet rear wall to support the cabinet channel within the cabinet. Consequently, the need for a rear channel mounting bracket is eliminated such that the drawer length and consequently drawer volume can be increased. In a preferred embodiment, the forked portion extends a relatively long distance along the channel enabling the cabinet channel to be secured within a variety of cabinets having different lengths.

In a fifth aspect of the invention, the drawer channel includes a lateral guide surface inclined from a vertical orientation to reduce the contact area between the cabinet channel and the drawer roller riding therein. The reduction of contact area facilitates ease of movement of the drawer within the cabinet and reduces noise during operation of the drawer.

These and other objects, advantages, and features of the invention will be more fully understood and appreciated by reference to the specification and drawings.

DETAILED DESCRIPTION OF THE PREFERRED EMBODIMENT

Figures 1, 2:
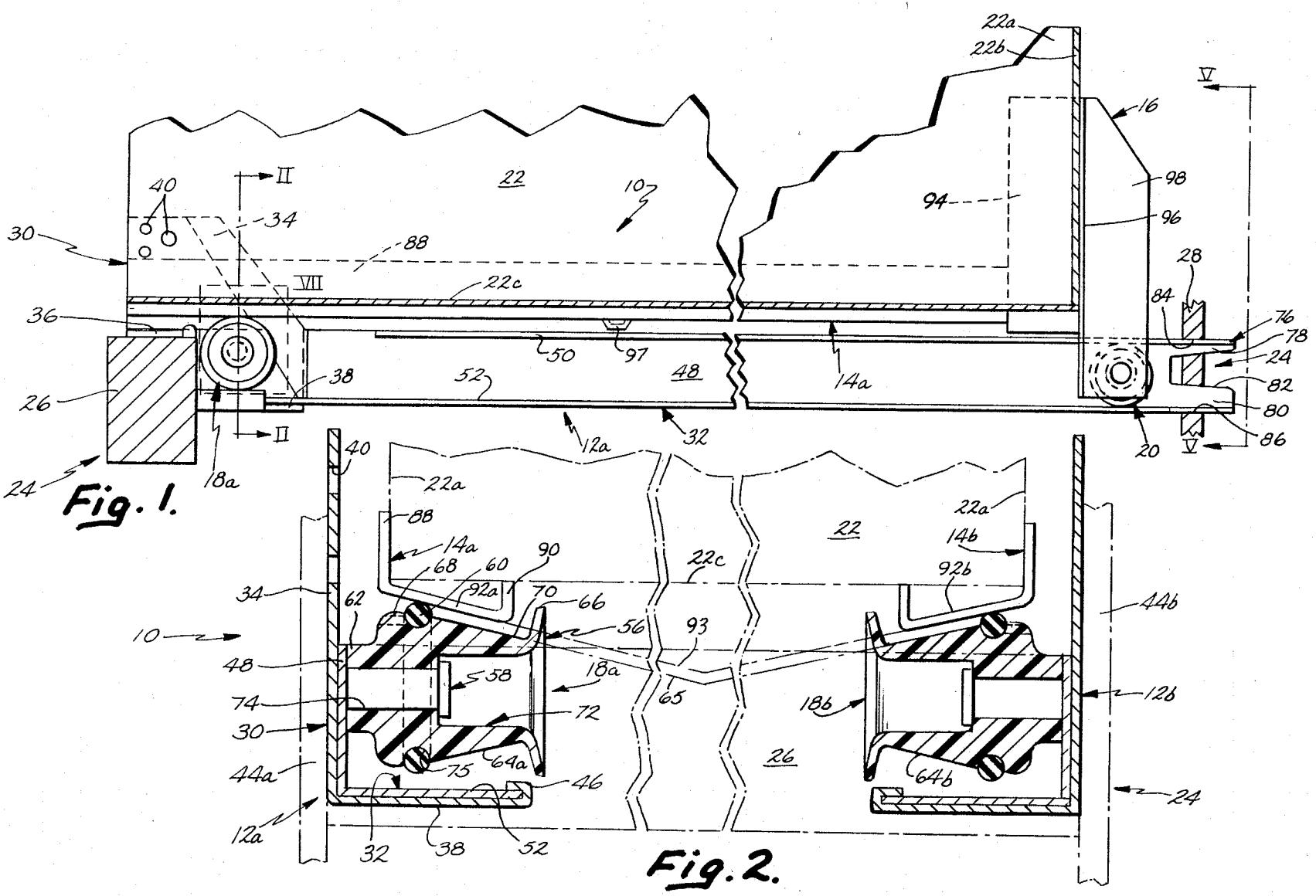
FIG. 1 is a fragmentary sectional view taken along the longitudinal axis of a drawer showing the drawer slide apparatus of the present invention supporting the drawer within a cabinet.
FIG. 2 is a sectional view showing the drawer and cabinet in phantom taken along plane II—II in FIG. 1.
Figure 5:
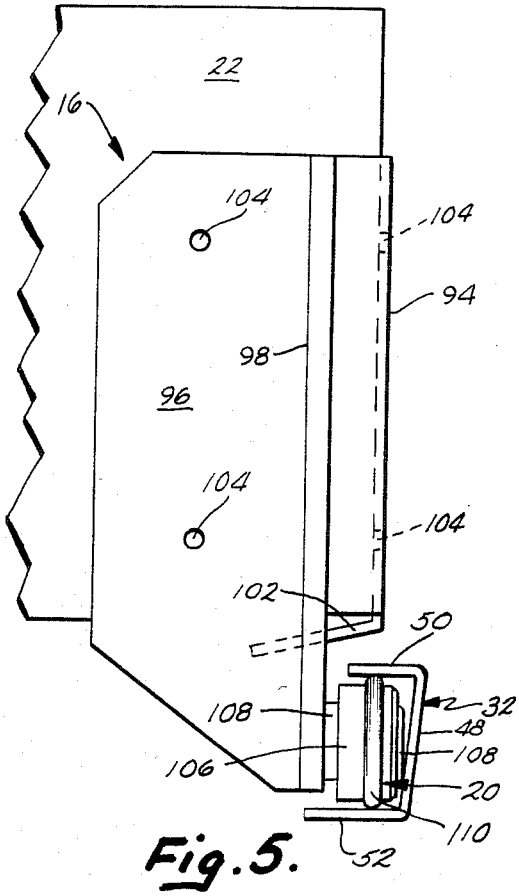
FIG. 5 is a fragmentary rear elevational view of the drawer corner bracket taken along plane V—V in FIG. 1.
Figure 6:
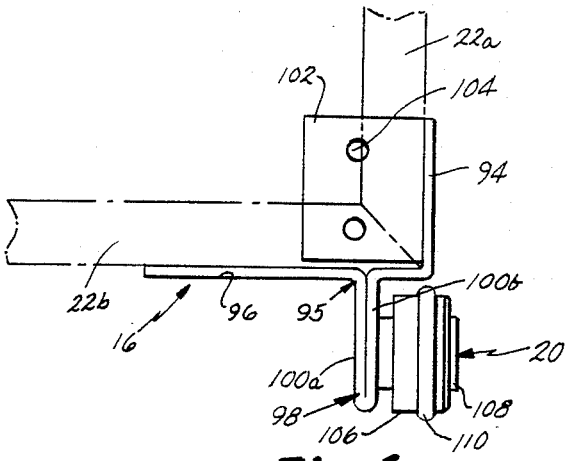
FIG. 6 is a top plan view of the drawer corner bracket showing the drawer in phantom.

A drawer slide assembly constructed in accordance with a preferred embodiment of the invention is illustrated in the drawings and generally designated 10. Generally, assembly 10 comprises a pair of cabinet channels 12 (FIGS. 1, 2, and 5), a pair of drawer rails 14 (FIGS. 1 and 2), and a pair of drawer corner brackets 16 (FIGS. 1, 5, and 6). Each of cabinet channels 12 (FIG. 1) rotatably supports a roller assembly 18, each of which carries a drawer rail 14. Each of the drawer corner brackets 16 rotatably supports a roller assembly 20 which rides within cabinet channels 12. Drawer rails 14 are secured about the lateral lower corners of drawer 22 (FIG. 2), while cabinet channels 12 are fixedly secured within the cabinet between forward frame member 26 and rear cabinet wall 28 (FIG. 1). Therefore, drawer 22 is mounted for horizontal reciprocating movement into and out of cabinet 24 on apparatus 10.

Cabinet channels 12*a* and 12*b* (FIG. 2) are generally mirror images of each other. Accordingly, only channel 12*a* will be described in detail, with channel 12*b* being the logical equivalent extension thereof. Cabinet channel 12*a* (FIGS. 1 and 2) comprises forward mounting bracket 30, channel portion 32 and roller assembly 18*a* rotatably supported at the junction of the forward bracket and the channel portion. Forward bracket 30 includes side plate 34, securing flange 36 extending generally perpendicular therefrom, and channel support flange 38 also extending generally perpendicularly from the sidewall. Sidewall 34 and securing flange 36 define a plurality of apertures 40 and 42, respectively, through which suitable fasteners may be inserted into the side frame member 44 and forward frame member 26 to secure channel 12*a* within cabinet 24. As most clearly seen in FIG. 2, channel supporting flange 38 extends from sidewall 34 and is folded upon itself to form C-shaped portion 46 entrapping bottom wall 52 of channel portion 32 therebetween. Therefore, channel portion 32 is secured between sidewall 34 and C-shaped portion 46 of bracket 30.

Figure 3:
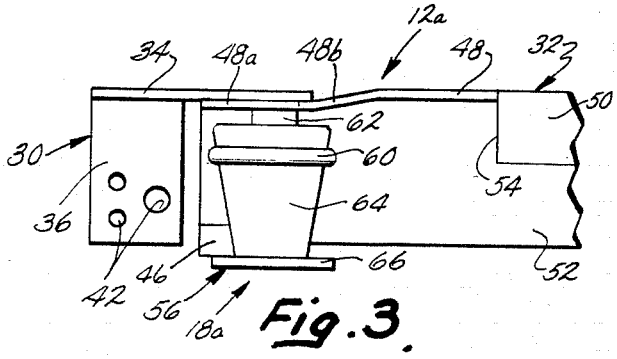
FIG. 3 is a fragmentary top plan view of the forward end of the cabinet channel.

Channel portion 32 (FIG. 5) is a C-shaped member including sidewall 48 and top and bottom walls 50 and 52. Sidewall 48 is inclined from the vertical at approximately an angle of 5° to reduce the contact area between roller assembly 20 and the sidewall. Top and bottom walls 50 and 52 are both generally horizontal and accordingly disposed at slightly acute and obtuse angles, respectively, to sidewall 48. Forward portion 48*a* (FIG. 3) of sidewall 48 is oriented generally vertically and connected to the remainder of sidewall 48 through deviation portion 48*b*. Forward wall portion 48*a* lies flat against sidewall 34 of forward bracket 30 (FIG. 2) to facilitate the securement of the two pieces together. Top wall 50 (FIGS. 2 and 3) includes a forward edge 54 which terminates at a distance from roller assembly 18 sufficient to permit roller assembly 20 to be inserted therebetween during installation of the drawer within the cabinet.

Roller assembly 18*a* (FIG. 2) includes roller 56, shoulder rivet 58, and O-ring 60. Roller 56 includes shoulder 62 which rotates against sidewall portion 48*a*, frustoconical portion or surface 64, and stop flange 66. Frustoconical portion 64 includes relatively large base 68 and relatively small base 70 and is inclined approximately 13° from the axis of roller 56. Frustoconical surfaces 64*a* and 64*b* facing drawer rails 14*a* and 14*b* form a segment of a downwardly tapering V-shape 65. Rollers 64 are mounted coaxially on a common horizontal axis below the cabinet opening partially defined by frame member 26. Annular stop flange 66 extends radially outwardly about the periphery of roller 56 from small base 70. Stepped bore 72 including reduced bore portion 74 is defined concentric with roller 56 to receive shoulder rivet 58 to secure the roller to channel portion 32 and bracket 30. Annular groove or recess 75 is defined about the periphery of sidewall 64 at an axial position closer large base 68 than small base 70. O-ring 60 is seated within groove 74.

Figure 4:
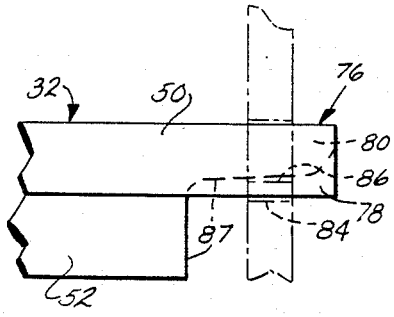
FIG. 4 is a fragmentary top plan view of the rear end of the cabinet channel.

Rear end 76 of channel portion 32 (FIGS. 2 and 4) is forked comprising a pair of tines 78 and 80. The tines are separated by a trapezoidally shaped cutout 82 such that both tines 78 and 80 taper to a reduced size toward the terminal end of channel portion 32. Rear cabinet wall 28 defines a pair of apertures 84 and 86 into which tines 78 and 80, respectively, extend. In the preferred embodiment, both of apertures 84 and 86 are generally circular to facilitate formation. Cutout 87 reduces the width of lower tine 80.

Drawer rails 14*a* and 14*b* (FIG. 2) are the mirror image of one another. Accordingly, only drawer rail 14*a* will be described in detail, with drawer rail 14*b* being the logical equivalent extension thereof. Rail 14*a* extends substantially the full length of drawer 22 terminating at corner bracket 16 (FIG. 2) and has a generally uniform cross section throughout its length (FIG. 2). Rail 14*a* comprises sidewall 88, spacing flange 90 generally parallel thereto and underwall 92 interconnecting the sidewall and the spacing flange. Both sidewall 88 and spacing flange 90 are generally vertically oriented with underwall 92 being inclined approximately 13° from the horizontal to be generally parallel to peripheral surface 64 of roller 56. Underwall 92 is located substantially directly under drawer 22. Spacing flange 90 engages drawer bottom 22*c* of drawer 22 to define the inclination of underwall 92. Underwalls 92*a* and 92*b* together define a portion or segment of a downwardly extending V-shape 93 generally parallel to V-shape 65 defined by frustoconical surfaces 64*a* and 64*b*.

Figure 7:
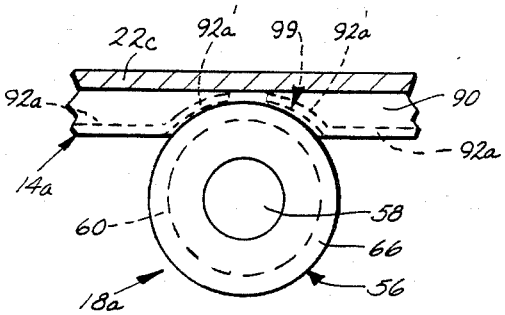
FIG. 7 is an enlarged view of the area within line VII in FIG. 1.

The travel of drawer 22 within cabinet 24 is restricted by stop 97 (FIG. 1) and detent 99 (FIG. 7). Stop 97 is formed in rail 14*a* and extends downwardly therefrom to engage roller 56 when drawer 22 is withdrawn from cabinet 24. The drawer can be removed from the cabinet only by lifting the drawer slightly and exerting a pulling force sufficient to cause stop 97 to pass over roller 56. Detent 99 is defined by underwall portions 92*a*′ which extend upwardly from the remainder of underwall 92*a* to engage, but not deform, drawer bottom 22*c*.

Drawer rear bracket 16 (FIGS. 1, 5, and 6) interconnects drawer sidewall 22*a* and rear wall 22*b* and supports roller assembly 20. More specifically, bracket 16 includes a one-piece plate 95 comprising first securing plate portion 94 secured to drawer side 22*a* and second securing plate portion 96 secured to drawer rear wall 22*b*. The portions 94 and 96 are oriented generally perpendicularly to one another to join members 22*a* and 22*b* at substantially a right angle. Roller supporting leg 98 extends generally perpendicularly from plate portion 96 and comprises a pair of halves 100*a* and 100*b* formed by bending plate 95 back on itself. Consequently, supporting leg 98 has a relatively thick construction to support assembly 20 while securing plate portions 94 and 96 are relatively thin but sufficient to securely interconnect members 22*a* and 22*b*. Bottom flange 102 is generally integral with and extends from portion 94 to be generally coplanar with underwall 92 of drawer rail 14*a*. Apertures are provided in all of portions 94, 96, and 102 to properly secure drawer bracket 16 to drawer 22.

Roller assembly 20 is generally well known to those having ordinary skill in the art and comprises roller 106 secured to supporting leg 98 by shoulder rivet 108. O-ring 110 is secured about the periphery of roller 106 to engage top and bottom walls 50 and 52 of channel portion 32. The outer diameter of O-ring 110 is substantially the same or slightly smaller than the internal distance between top and bottom walls 50 and 52.

In the preferred embodiment, both cabinet channel 12 and drawer rail 14 are fabricated of AISI No. 1010 coldrolled carbon steel strip plated with 0.02 to 0.04 mils of immersion copper plate. The material of which both rollers 56 and 106 are fabricated is a thermo-plastic polyamide resin such as the general-purpose Nylon type 66 manufactured by Dupont under the trade designation ZYTEL 101FNC-10. O-rings 60 and 110 are fabricated of 70 durometer neoprene.

ASSEMBLY AND OPERATION

Drawer slide apparatus 10 is supported in cabinet 24 on rear wall 28 and on frame members 44 and 26. Typically, cabinet channels 12 are fully assembled during manufacture with channel portion 32 crimpingly held by channel flange 38 on bracket 30 and with roller assembly 18 secured to both channel portion 32 and bracket 30 by shoulder rivet 58. A cabinet opening is defined by side frame members 44*a* and 44*b* and interconnecting lower frame member 26 (FIG. 2). Channels 12 are inserted through the cabinet opening, and tines 78 and 80 are inserted into apertures 84 and 86, respectively, in rear cabinet wall 28 (FIG. 1). Preferably, apertures 84 and 86 are formed to freely receive the narrowest portion of tines 78 and 80. As the tines are force fitted into the apertures to the position shown in FIG. 1, the tines frictionally engage the peripheries of apertures 84 and 86 to secure a snug fit between cabinet channel 12 and rear cabinet wall 28. When channel flange 38 passes behind lower frame member 26, bracket 30 is lowered until securing flange 36 rests on the frame member. Suitable fasteners are then inserted as necessary through apertures 40 in sidewall 34 and apertures 42 in securing flange 36 (see also FIG. 3) to complete the securement of cabinet channel 12 within cabinet 24.

Either before or after the installation of cabinet channels 12 within cabinet 24, rails 14 and drawer brackets 16 are secured to drawer 22. Rails 14 are secured to drawer 22 with sidewalls 88 lying adjacent drawer sides 22*a* and abutment flange 90 abutting drawer bottom 22*c*. Fasteners are inserted through either sidewall 88 or underwall 92 to secure rail 14 to drawer 22. Drawer bracket 16 is secured to drawer 22 by abutting securing portions 94 and 96 against drawer sidewall 22*a* and rear wall 22*b*, respectively, and inserting suitable fasteners through apertures 104 to secure the bracket to the drawer.

Drawer 22 having rails 14 and corner bracket 16 installed thereon is inserted into cabinet 24 through the cabinet opening. Roller assemblies 20 are positioned between top and bottom walls 50 and 52 of channel portion 32 by inserting the roller assemblies between cabinet roller assembly 18*a* and forward edge 54 of top wall 50 and then forcing the drawer rearwardly in the cabinet with roller assembly 20 riding in channel portion 32 and with rail 14 riding on cabinet roller 18. Stop 97 is urged over cabinet roller 18 by lifting the drawer slightly, and drawer 22 is slid to the rear of cabinet 24 until detent 99 rests on roller 56 to maintain the drawer in its closed position. When the center of balance of drawer 22 is forward of roller assemblies 18*a* as viewed in FIG. 1, roller assemblies 20 bear upwardly against top wall 50 of channel portion 32. When the center of gravity of the drawer 22 is located rearwardly of roller assembly 18, roller assemblies 20 bear downwardly against bottom wall 52 of channel portion 32.

As most clearly seen in FIG. 2, the cooperating drawer rails 14 and roller assemblies 18 urge drawer 22 to a centered position within cabinet 24. That is to say that underwalls 92*a* and 92*b* ride on O-rings 60 and rollers 56 and seek a low position between the O-rings to guide the drawer to a centered position. The engagement of spacer flange 90 with stop flange 66 insures that drawer 22 will not shift excessively laterally to the right and likewise the similar structure on roller assembly 18*b* insures that the drawer will not shift excessively laterally to the left. It is conceivable that only one of (1) rails 14 and (2) rollers 18 would define the V-shaped segment causing the drawer to seek a centered position.

The possible compression of O-rings 60 is limited by the depth of grooves 75 in which the rings are seated. This construction increases O-ring life and reduces the compression set of the O-rings.

As most clearly seen in FIG. 5, roller assembly 20 engages channel sidewall 48 of channel portion 32 at a single point due to the inclination of the sidewall. The reduced contact between the roller assembly and the sidewall facilitates movement of the drawer on the drawer slide apparatus and also reduces noise during drawer movement.

The above description is intended to be that of a preferred embodiment of the invention. Various changes and alterations might be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. A drawer slide assembly comprising:

first and second rollers adapted to be rotatably supported on opposite sides of a cabinet, each of said rollers including a load-bearing, generally frustoconically shaped portion, each of said rollers having an inwardly directed smaller end, said frustoconically shaped portions of said first and second rollers thereby defining a portion of a first upwardly opening V centered in the cabinet;

first and second drawer rails adapted to be fixedly secured to opposite sides of a drawer and each including a riding surface supported on said first and second frustoconically shaped roller portions, respectively, said first and second riding surfaces being directly under the drawer and defining a portion of a second upwardly opening V centered on the drawer, the legs of said first and second Vs being generally parallel when the drawer is in a centered position with respect to the cabinet, said riding surfaces being free to move with respect to said rollers in a direction generally parallel to the axes of rotation of said rollers as said rails ride on said rollers, whereby the drawer is free to travel transversely within the cabinet to be guided to the centered position with respect to the cabinet as said rails ride on said rollers; and said roller further including lateral stop means for limiting the lateral travel of the drawer from the centered position, said lateral stop means including an annular flange extending radially from the smaller end of each of said frustoconically shaped roller portions, said annular flanges limiting the lateral movement of said rails along said frustoconically shaped roller portions.

2. A drawer slide assembly as defined in claim 1 wherein the drawer includes a bottom; and wherein each of said rail riding surfaces includes first and second generally parallel edges and a spacing flange extending upwardly from said second edge, said first edge and said spacing flange engaging the drawer bottom to space said riding surfaces at an angle from the drawer bottom.

3. A drawer slide assembly as defined in claim 1 wherein each of said rail riding surfaces is inclined approximately 13° from the drawer bottom.

4. A drawer slide assembly comprising:

a pair of rollers to be supported on opposite sides of a cabinet opening, each of said rollers being generally frustoconically shaped with their small ends facing one another, whereby the upper surfaces of said rollers define a portion of a first upwardly opening V centered in the cabinet opening;

a pair of drawer rails to be fixedly secured to opposite sides of a drawer to ride on said rollers, each of said rails including a riding surface supported on one of said rollers, said first and second riding surfaces being directly under the drawer and defining a portion of a second upwardly opening V, the legs of said first and second Vs being generally parallel when the drawer is in a centered position with respect to the cabinet opening, said rails having at least some freedom to move with respect to said rollers in a direction generally parallel to the axes of rotation of said rollers as said rails ride on said rollers, whereby the drawer has some freedom to move transversely within the cabinet opening to seek the centered position with respect to the cabinet opening as said rails ride on said rollers; and said rollers further including lateral stop means for limiting the lateral travel of the drawer from the centered position, said lateral stop means including an annular flange extending radially from the smaller end of each of said frustoconically shaped roller portions, said annular flanges limiting the lateral movement of said rails along said frustoconically shaped rollers.

5. A drawer slide assembly as defined in claim 4 wherein each of said rail riding surfaces is inclined approximately 13° from the bottom of the drawer.

6. A drawer slide assembly as defined in claim 4 wherein each of said rail riding surfaces includes first and second parallel edges and a spacer flange extending upwardly from said second edge, both said first edge and said spacer leg engaging the drawer bottom to maintain said riding surfaces at an angle to the drawer bottom.

7. An improved drawer and cabinet assembly including a cabinet having an opening, a drawer, and slide means for mounting said drawer within said cabinet to be slidable through said opening, wherein the improvement comprises said slide means comprising:

a pair of rollers supported on opposite sides of said cabinet opening, each of said rollers being generally frustoconically shaped with their small ends facing one another, whereby the upper surfaces of said rollers define a portion of a first upwardly opening V centered in said cabinet opening;

a pair of drawer rails fixedly secured to opposite sides of said drawer to ride on said rollers, each of said rails including a riding surface supported on one of said rollers, said first and second riding surfaces being directly under said drawer and defining a portion of a second upwardly opening V, the legs of said first and second Vs being generally parallel when said drawer is in a centered position with respect to said cabinet opening, said rails having at least some freedom to move with respect to said rollers in a direction generally parallel to the axes of rotation of said rollers as said rails ride on said rollers, whereby said drawer has some freedom to move transversely within said cabinet opening to seek the centered position with respect to said cabinet opening as said rails ride on said rollers; and said rollers further including lateral stop means for limiting the lateral travel of said drawer from the centered position, said lateral stop means including an annular flange extending radially from the smaller end of each of said frustoconically shaped rollers, said annular flanges limiting the lateral movement of said rails along said frustoconically shaped rollers.

8. An improved drawer and cabinet assembly as defined in claim 7 wherein each of said rail riding surfaces includes first and second parallel edges and a spacer flange extending upwardly from said second edge, both said first edge and said spacer flange engaging the drawer bottom to maintan said riding surfaces at an angle to said drawer bottom.

9. An improved drawer slide assembly as defined in claim 7 wherein each of said rail riding surfaces is inclined approximately 13° from said drawer bottom.

10. A drawer slide assembly comprising:

first and second rollers adapted to be rotatably supported on opposite sides of a cabinet, each of said rollers including a load-bearing, generally frustoconically shaped portion, each of said rollers having an inwardly directed smaller end, said frustoconically shaped portions of said first and second rollers thereby defining a portion of a first upwardly opening V centered in the cabinet;

first and second drawer rails adapted to be fixedly secured to opposite sides of a drawer and each including a riding surface supported on said first and second frustoconically shaped roller portions, respectively, said first and second riding surfaces defining a portion of a second upwardly opening V centered on the drawer, the legs of said first and second Vs being generally parallel when the drawer is in a centered position with respect to the cabinet, said riding surfaces being free to move with respect to said rollers in a direction generally parallel to the axes of rotation of said rollers as said rails ride on said rollers, whereby the drawer is free to travel transversely within the cabinet to be guided to the centered position with respect to the cabinet as said rails ride on said rollers; and said rollers further including lateral stop means for limiting the lateral travel of the drawer from the centered position, said lateral stop means including an annular flange extending radially outwardly from the smaller end of each of said frustoconically shaped roller portions, each of said rails including an inner portion which engages said associated roller flange when the drawer moves laterally an undesired distance from the centered position to limit the lateral movement of said rails along said frustoconically shaped roller portions.

* * * * *